US006483494B1

(12) United States Patent
Liaw et al.

(10) Patent No.: US 6,483,494 B1
(45) Date of Patent: Nov. 19, 2002

(54) MULTISTAGE CHARGING CIRCUIT FOR DRIVING LIQUID CRYSTAL DISPLAYS

(75) Inventors: Ming-Jiun Liaw, Hsinchu (TW); Ho-Hsin Yang, TaiNan (TW); Yuh-Ren Shen, TaiNan (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 09/578,000

(22) Filed: May 24, 2000

(51) Int. Cl.[7] ..... G09G 3/36

(52) U.S. Cl. ..... 345/92; 345/87; 345/96; 345/99; 345/209; 345/211; 345/212; 345/100; 345/95

(58) Field of Search ..... 345/92, 87, 100, 345/103, 95, 206, 208, 211, 212, 213, 94, 96, 99, 209, 98, 214; 257/351; 327/111

(56) References Cited

U.S. PATENT DOCUMENTS 6,127,997 A * 10/2000 Tsuchi ..... 345/100
6,297,793 B1 * 10/2001 Kawahata ..... 345/87

* cited by examiner

*Primary Examiner*—Richard Hjerpe
*Assistant Examiner*—Ali Zamani

(57) ABSTRACT

Disclosed is a multistage charging circuit for driving liquid crystal displays, designed particularly to provide a multistage charging driving circuit for liquid crystal display, in which the pixels can be pre-charged to a determined voltage value before the next data are written by performing charge-sharing and pre-charge. Due to the fact that the voltage and the next data have the same polarity, the problems resulted from gray-scale voltage imprecision and latch up at the output can be prevented and thus high gray-scale precision and low power dissipation can be achieved.

14 Claims, 13 Drawing Sheets

MULTISTAGE CHARGING CIRCUIT FOR DRIVING LIQUID CRYSTAL DISPLAYS

BACKGROUND OF THE INVENTION

1. Field of the Invention

The present invention generally relates to a driving circuit with multistage charging for liquid crystal displays, and more particularly to a driving circuit, which is able to perform charge-sharing and pre-charge on the pixels of liquid crystal displays.

2. Description of the Prior Art

Recently, due to the fast development in electro-optics and semiconductor technology, the related techniques compatible with multimedia applications of displays have grown rapidly. The advantages of a liquid crystal display (to be abbreviated as LCD here below), in contrast to conventional displays, include smaller size and better moving picture quality and image display characteristics. At present, the technical fields according to LCDs, especially those related to the driving circuit of a thin film transistor-liquid crystal display (TFT-LCD), have become the key techniques.

The conventional techniques for driving TFT-LCDs, wherein the voltage output range of a data driver varies with the polarity alternating of pictures alternating, suffer from high power dissipation and include: (1) charge-sharing by using a large external storage capacitor; and (2) pixels of different polarities driven by different data drivers. However, there still exist problems due to gray-scale voltage imprecision and latch up at the output.

As mentioned above, power dissipation and gray-scale voltage precision are two important references by which the performance of a driving circuit of a LCD is judged. It is well known that the output power dissipation is proportional to the square of voltage swing. Please refer to FIG. 1A and FIG. 1B, which respectively illustrate a schematic driving circuit of a liquid crystal display using vertical signals and the relation between the liquid crystal applied voltage and liquid crystal transmittance in the prior art. As shown in FIG. 1A and FIG. 1B, the driving circuit must follow the polarity alternating of data signals in order to change its range of dynamic operation. Even though only the positive half cycle or the negative half cycle of the voltage range is used, as shown in FIG. 2, the voltage range of dynamic operation at the output stage of the entire driving circuit must be two times the voltage range as the uni-polarity case is concerned. In other words, the output must be able to provide considerably large voltage swing and thus the power dissipation is increased.

One of the approaches to reduce the power dissipation is to lower the voltage swing at the output stage. To achieve such object, several improved driving methods, as shown in FIG. 3A, FIG. 3B and FIG. 4, have been claimed. Among them, as can be seen in FIG. 3A, a considerably large external storage capacitor 66 may be coupled between ground and common node 65, and the capacitance of the external storage capacitor 66 is much larger than the sum of all the capacitance of the pixels. The external storage capacitor 66 averages the voltages, over time, applied to the columns of the array. Before the data are written (as presented by intervals $t_0$~$t_1$ and $t_2$~$t_3$ in the waveform timing diagram shown in FIG. 3B), SELECT goes high, shorting column 2 through mutliplexer 78 to external storage capacitor 66 and resulting in charge-sharing. In practice, the value of external capacitor 66 is large enough to sink such charges without producing a noticeable variation in the voltage there across, therefore the voltage on Column 2 drops to approximately ground potential, as shown in FIG. 3B. In such manner, the voltage swing is reduced.

Please further refer to FIG. 4, which is a circuit diagram in accordance with U.S. Pat. No. 5,748,165, wherein the positive-polarity voltage and negative-polarity voltage are supplied by different output terminals, respectively. For example, the positive-polarity voltage is supplied by the upper output terminal (OP+) and the negative-polarity voltage is supplied by the lower output terminal (OP−). In this manner, the output voltage swings at both the upper output and the lower output are decreased to half as compared to the conventional technique, as shown in FIG. 1.

However, the above improved driving methods remain unable to solve two major problems such as:

(1) Gray-scale voltage imprecision: Within the time constant $\tau=R*C$, the response of an STC circuit to an input signal can never reaches the initial value of the input signal. The difference between the initial value and the response value decreases with time, and thus the voltage deviation the liquid crystal cell holds decreases. However, in the methods as illustrated in FIG. 1A and FIG. 3A, the initial voltage and response voltage have opposite polarities. Therefore, the voltage deviation the liquid crystal cell holds can not be neglected.

(2) Latch up at the output: As can be seen in FIG. 4, when the liquid crystal cell is turned on, the upper output (OP+) "sees" the negative-polarity voltage of the prior frame, resulting in latch up.

Accordingly, in order to overcome the above problems, the present invention provides an improved circuit, which is able to perform charge-sharing and pre-charge at the same time.

SUMMARY OF THE INVENTION

It is a main object of the present invention to provide, a multistage charging driving circuit for liquid crystal displays, characterized in that the pixel is charged to a fixed value by performing charge-sharing and pre-charge before the next data are written. Since the charged pixel and the next data have the same polarity, the latch up at the output of the driving circuit can be prevented. In addition, the fixed voltage value is set to be around the median gray-scale, therefore, during the same data-write time, the median gray-scale voltage has better accuracy than in the prior arts.

It is another object of the present invention to provide a multistage charging driving circuit for liquid crystal displays, characterized in having better accuracy in median gray-scale voltage and lower power dissipation, preventing the latch up at the output of the driving circuit.

In order to achieve the foregoing objects, the present invention provides an improved circuit, which is able to perform charge-sharing and pre-charge on the pixels of liquid crystal displays, comprising (1) switches for performing charge-sharing and pre-charge; and (2) voltage levels for pre-charge (M(+) and M(−), the output of M being positive or negative-polarity voltage) and voltage selection controllers ($C_1$~$C_M$). All these components can be implemented outside the pixel region.

It is preferable that, according to the present invention, the circuit being able to perform charge-sharing and pre-charge can be further coupled to an external storage capacitor with large capacitance in order to reduce the voltage swing at the output.

BRIEF DESCRIPTION OF THE DRAWINGS

The objects, spirits and advantages of the preferred embodiments of the present invention will be readily understood by the accompanying drawings and detailed descriptions, wherein:

FIG. 5B is a circuit diagram based on the. FIG. 5A in accordance with the first embodiment of the present invention, characterized in that external storage capacitors are coupled between ground and the charge storage lines;

DETAILED DESCRIPTION OF THE INVENTION

The present invention relates to a multistage charging driving circuit for liquid crystal displays, structured to be able to perform multistage pre-charge and polarity-alternating pre-charge on the pixels of liquid crystal displays. Multiple pre-charge indicates using selecting signal $C_1, C_2 \ldots C_M$ to select the pre-charge voltage ($V_1, V_2 \ldots V_M$ for positive polarity and $V_1', V_2' \ldots V_M'$ for negative polarity). For detailed description, please refer to FIG. 5A, wherein the pre-charged voltage is charged, stage by stage, to a proper determined voltage value (for example, 7.5 volts for positive polarity and 2.5 volts for negative polarity). In addition, the polarity-alternating pre-charge indicates that the first charge storage line $L_1$ 151 charges a frame to positive polarity and then charges a next frame to negative polarity.

Figures 1A, 1B:
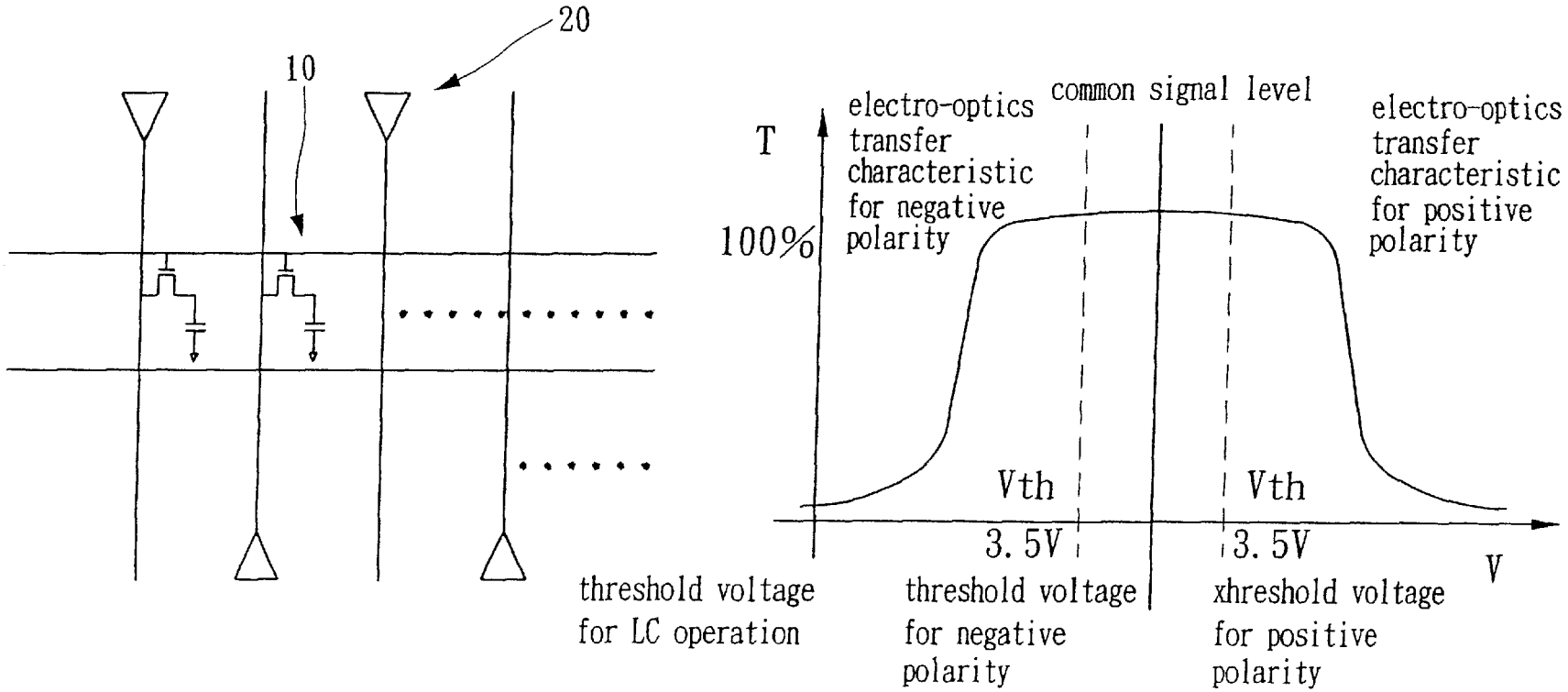
FIG. 1B (Prior Art)
FIG. 1A (Prior Art)
FIG. 1A is a circuit diagram showing a schematic driving circuit of a liquid crystal display using vertical signals in the prior art.
FIG. 1B is a graph showing the relation between the liquid crystal applied voltage and liquid crystal transmittance in the prior art.
Figure 2:
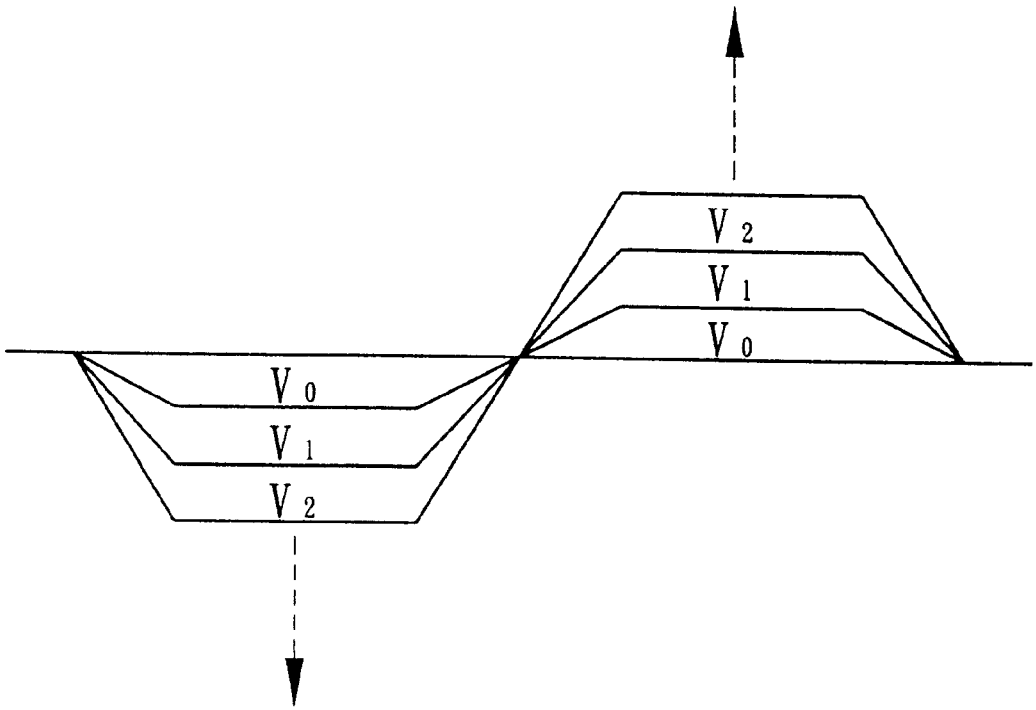
FIG. 2 (PRIOR ART)
FIG. 2 is a graph showing the voltage swing at the output stage of the driving circuit in the prior art.
Figure 3B:
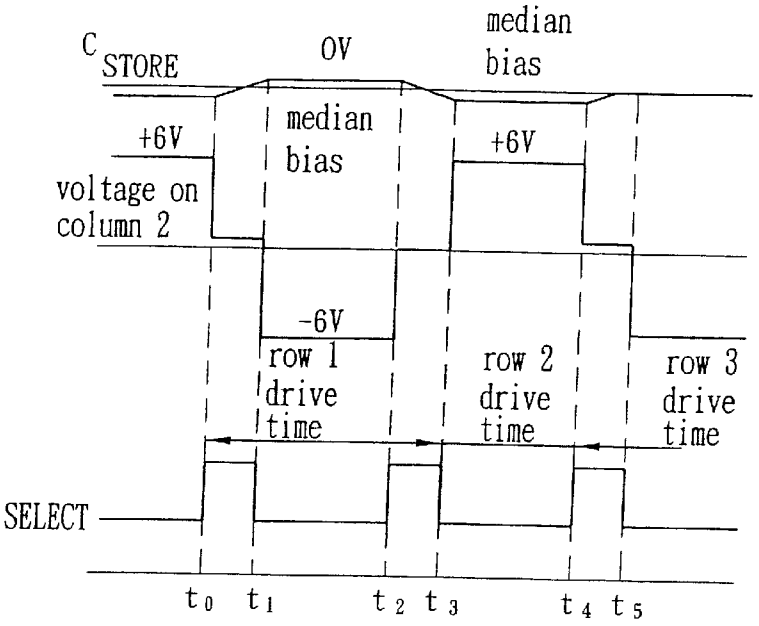
FIG. 3B (Prior Art)
FIG. 3B is a waveform timing diagram illustrating a clocked control signal dividing three row drive periods into first and second portions, and illustrating the voltages upon an external storage capacitor and upon one column in the array in accordance with U.S. Pat. No. 5,852,426.
Figure 3A:
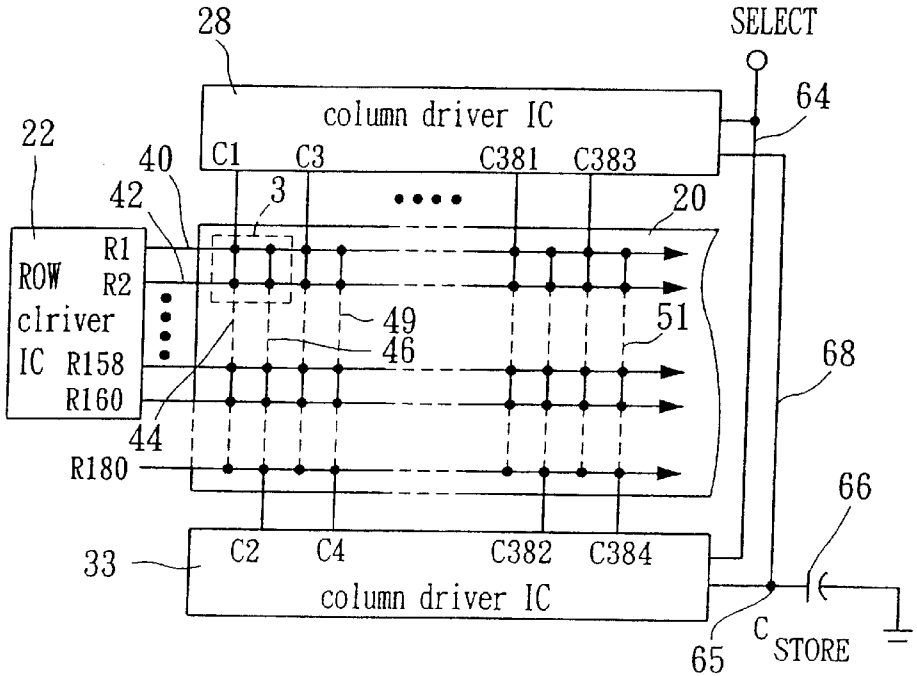
FIG. 3 A (Prior Art)
FIG. 3A is a block diagram of a portion of an active matrix LCD display including two column driver integrated circuits, one row driver integrated circuit, and several of the row and column conductors of the active matrix display in accordance with U.S. Pat. No. 5,852,426.
Figure 4:
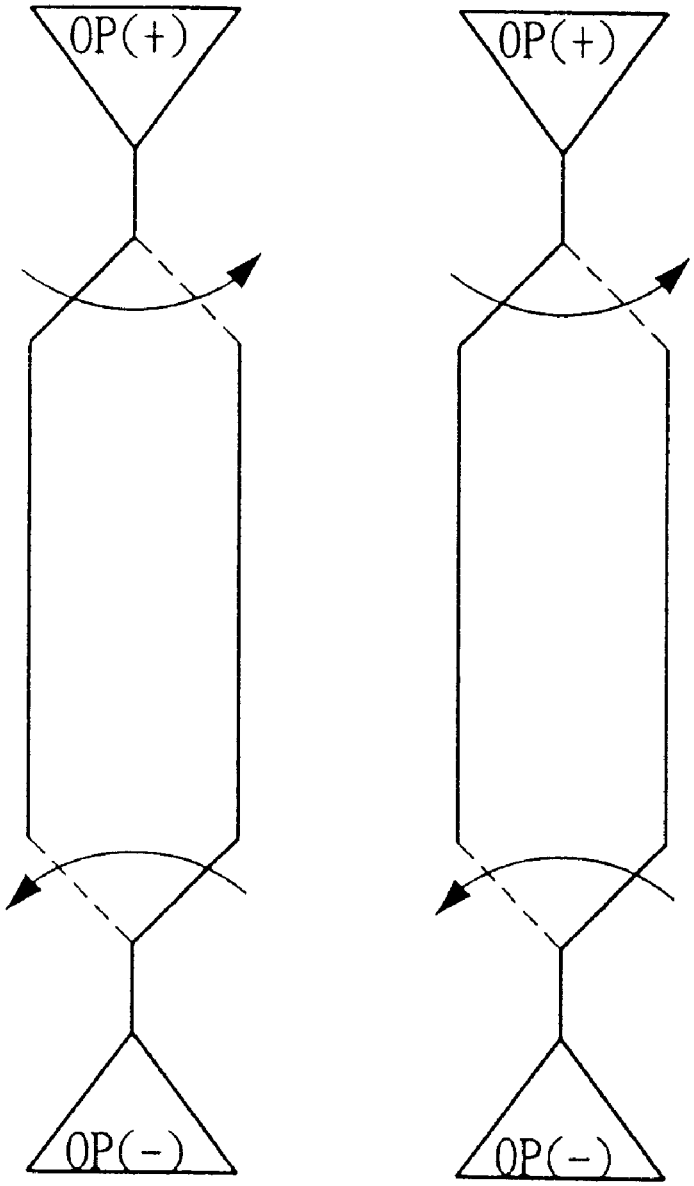
FIG. 4 (PRIOR ART)
FIG. 4 is a circuit diagram in accordance with U.S. Pat. No. 5,748,165, wherein the positive-polarity voltage and negative-polarity voltage are supplied by different output terminals, respectively.
Figure 5A:
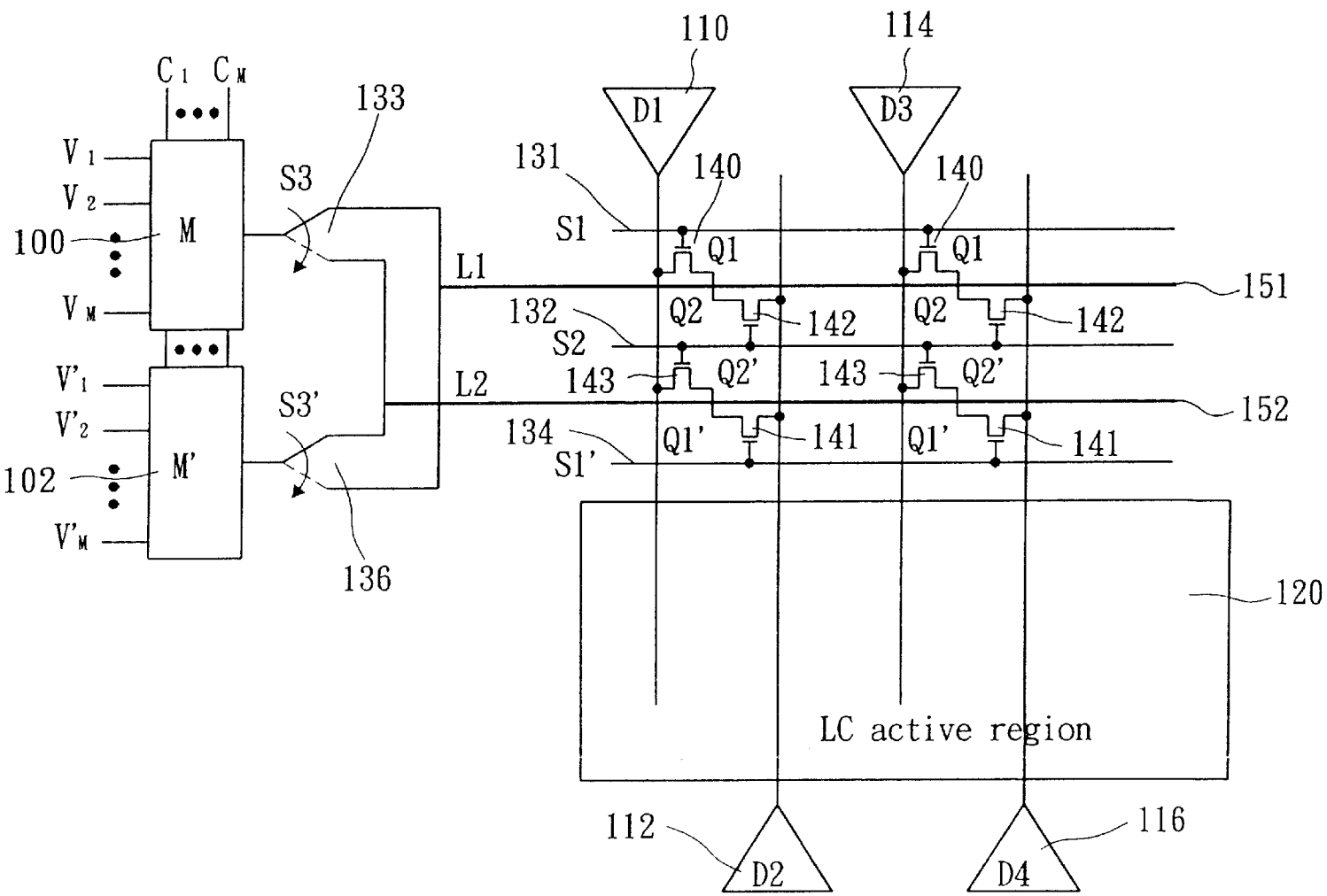
FIG. 5A is a circuit diagram showing a schematic driving circuit of a liquid crystal display in accordance with the first embodiment of the present invention.

For further detailed description of the circuit implementation of the present invention, please refer to FIG. 5A, which a circuit diagram showing a schematic driving circuit of a liquid crystal display in accordance with the first embodiment of the present invention, comprising: multistage voltage regulation circuits 100 and 102, coupled to voltage sources ($V_1, V_2 \ldots V_M$ for positive polarity and $V_1', V_2' \ldots V_M'$ for negative polarity) for providing different voltage levels selected by selecting signal $C_1, C_2 \ldots C_M$; and a plurality of charge/discharge signal lines $S_1, S_1', S_2, S_3, S_3'$ and charge storage lines $L_1$ and $L_2$, wherein a pair of pre-charge signal lines $S_3$ and $S_3'$ are connected to the output of said multistage voltage regulation circuits 100 and 102, respectively, and the other ends of said pair of pre-charge signal lines $S_3$ and $S_3'$ are connected to said charge storage lines $L_1$ and $L_2$, respectively, so as to store and/or release the charge.

As shown in FIG. 5A, a pair of charge/discharge signal lines $S_1$ and $S_1'$ and a signal line $S_2$ are coupled and interlacingly arranged in parallel with said charge storage lines $L_1$ and $L_2$. A plurality of pairs of switches $Q_1, Q_1', Q_2$, and $Q_2'$ are arranged between said plurality of charge/discharge signal lines $S_1, S_1', S_2$ and charge storage lines $L_1$ and $L_2$, wherein said plurality of pairs of switches $Q_1, Q_1', Q_2$, and $Q_2'$ perform charge-sharing and pre-charge by using said charge storage lines $L_1$ and $L_2$ to store and/or release the charge.

To be more specific, the interlacing arrangement is characterized in that the first odd-numbered charge/discharge signal line $S_1$ is followed by the first charge storage line $L_1$, then the second odd-numbered charge/discharge signal line $S_2$, then the second charge storage line $L_2$, and finally the first even-numbered charge/discharge signal line $S_1'$. Besides, the pre-charge signal lines $S_3$ and $S_3'$ can be switched to determine the polarity of said first and second charge storage lines $L_1$ and $L_2$.

As shown in FIG. 5A, a plurality of driving circuits $D_1$, $D_2$, $D_3$ and $D_4$ are interlacingly arranged at the sources and the drains of said plurality of pairs of switches $Q_1, Q_1', Q_2$, and $Q_2'$, so as to determine the ON/OFF state of the switches and perform charge-sharing and pre-charge. Said plurality of pairs of switches are different from the data switches of the plurality of pixels of LCDs. Furthermore, said charge storage lines can be implemented by using a metal wire so as to perform charge storage and reduce the voltage swing.

More particularly, the arrangement of the charge/discharge signal lines $S_1$ and $S_2$, the charge storage lines $L_1$ and $L_2$, along with the switches $Q_1, Q_1', Q_2$, and $Q_2'$ is characterized in that the gates of the first switches $Q_1$ on odd-numbered columns are coupled to the first charge/discharge signal line $S_1$ on said odd-numbered columns, and the other two terminals (i.e., drains and sources) of the first switches $Q_1$ on said odd-numbered columns are coupled to driving circuits $D_1$, $D_3$, and the first charge storage line $L_1$; that the gates of the second switches $Q_2$ on even-numbered columns are coupled to the second charge/discharge signal line $S_2$ on said odd/even-numbered columns, and the other two terminals (i.e., drains and sources) of the second switches $Q_2$ on even-numbered columns are coupled to driving circuits $D_2$, $D_4$, and the first charge storage line $L_1$; that the gates of the second switches $Q_2'$ on said odd-numbered columns are coupled to second charge/discharge signal line $S_2$ on said odd/even-numbered columns, and the other two terminals (i.e., drains and sources) of the second switches $Q_2'$ on said odd-numbered, columns are coupled to driving circuits $D_1$, $D_3$, and the second charge storage line $L_2$; and that the gates of the first switches $Q_1'$ on said even-numbered, columns are coupled to the first charge/discharge signal line $S_1'$ on said even-numbered columns, and the other two terminals (i.e., drains and sources) of the first switches $Q_1'$ on said even-numbered columns are coupled to driving circuits $D_2$, $D_4$, and the second charge storage line $L_2$.

Figure 5B:
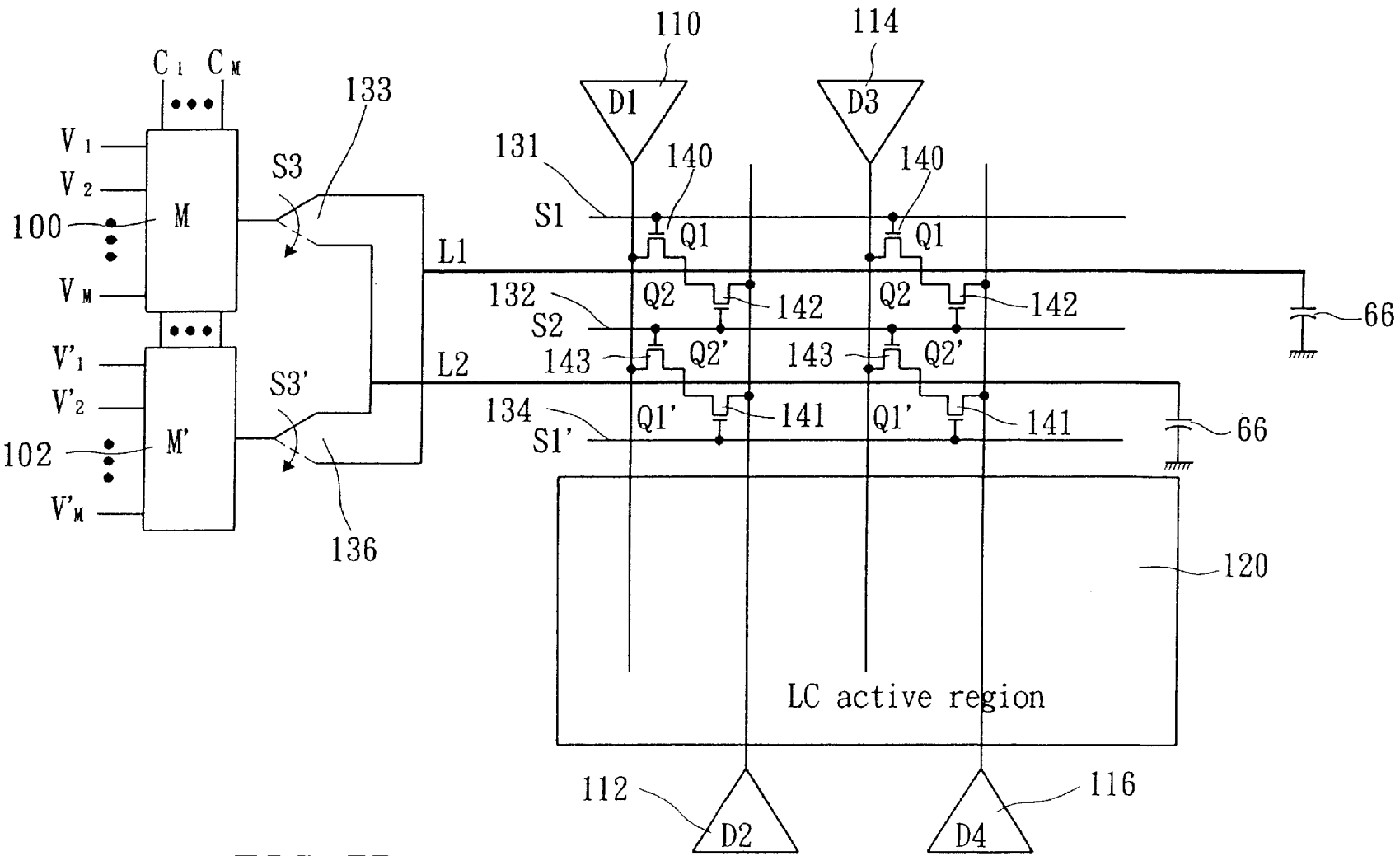

On the other hand, for another embodiment of the present invention, please refer to FIG. 5B, which is a circuit diagram based on the FIG. 5A in accordance with the first embodiment of the present invention, characterized in that external storage capacitors are coupled between ground and the charge storage lines as shown in FIG. 5B, so as to store the charge. In other words, the major difference of the implementation of FIG. 5B from that of FIG. 5A is that additional external storage capacitors 66 are coupled between ground and the charge storage lines in order to reduce the voltage swing.

Figure 6:
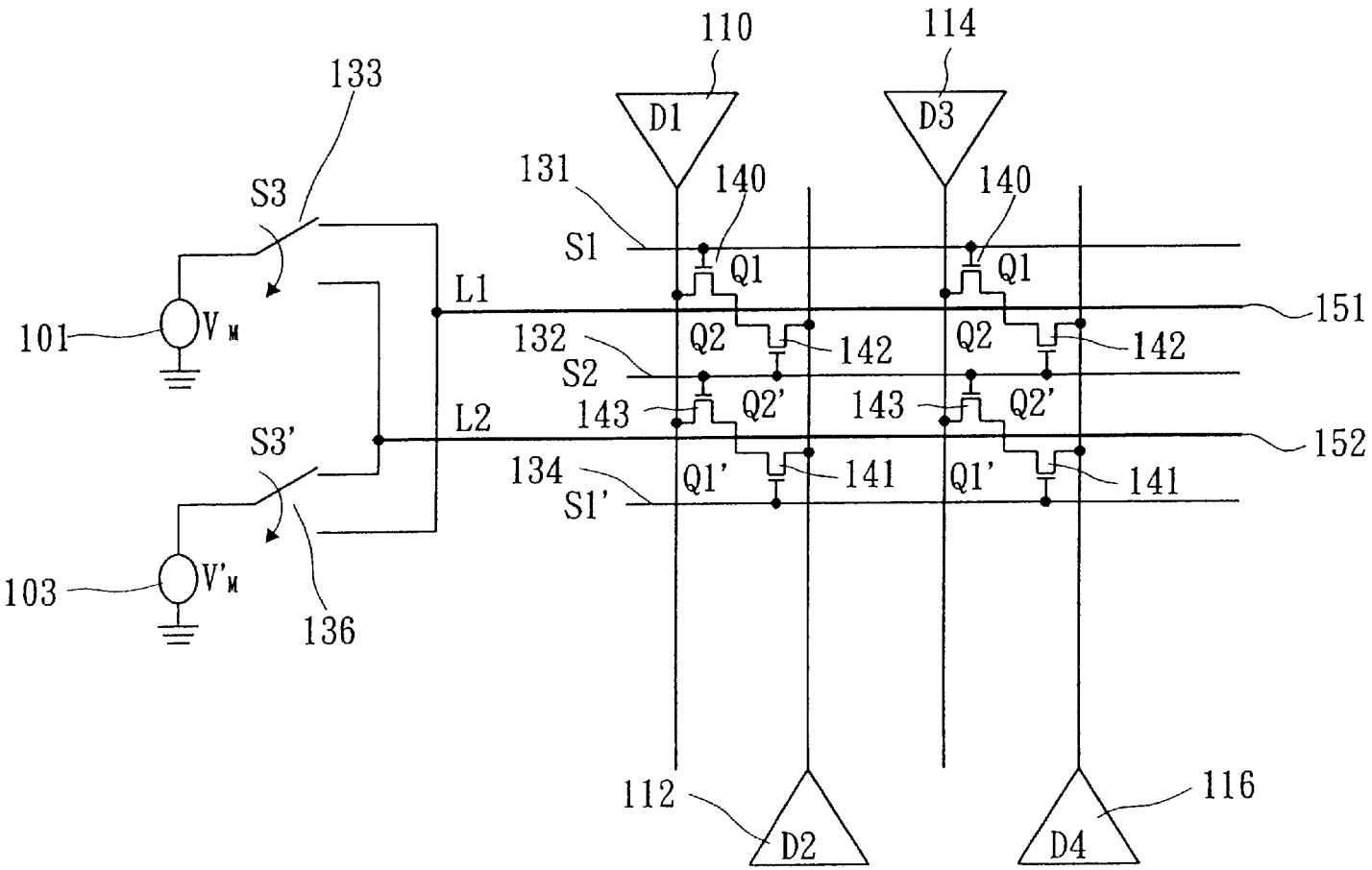
FIG. 6 is a circuit diagram showing a schematic driving circuit of a liquid crystal display in accordance with the second embodiment of the present invention.

The circuit configuration of the present invention can be further simplified to single-stage pre-charge type. In other words, a proper determined voltage value (for example, 7.5 volts for positive polarity and 2.5 volts for negative polarity) is provided when pre-charge is performed instead of a stage-by-stage approach. The simplified circuit configuration is shown in FIG. 6. Such a simplified circuit configuration also provides polarity-alternating pre-charge to make $L_1$ and $L_2$ charge different frames to the same polarity by controlling the turn-on sequence of $Q_1$, $Q_1'$, $Q_2$ and $Q_2'$.

Figure 7:
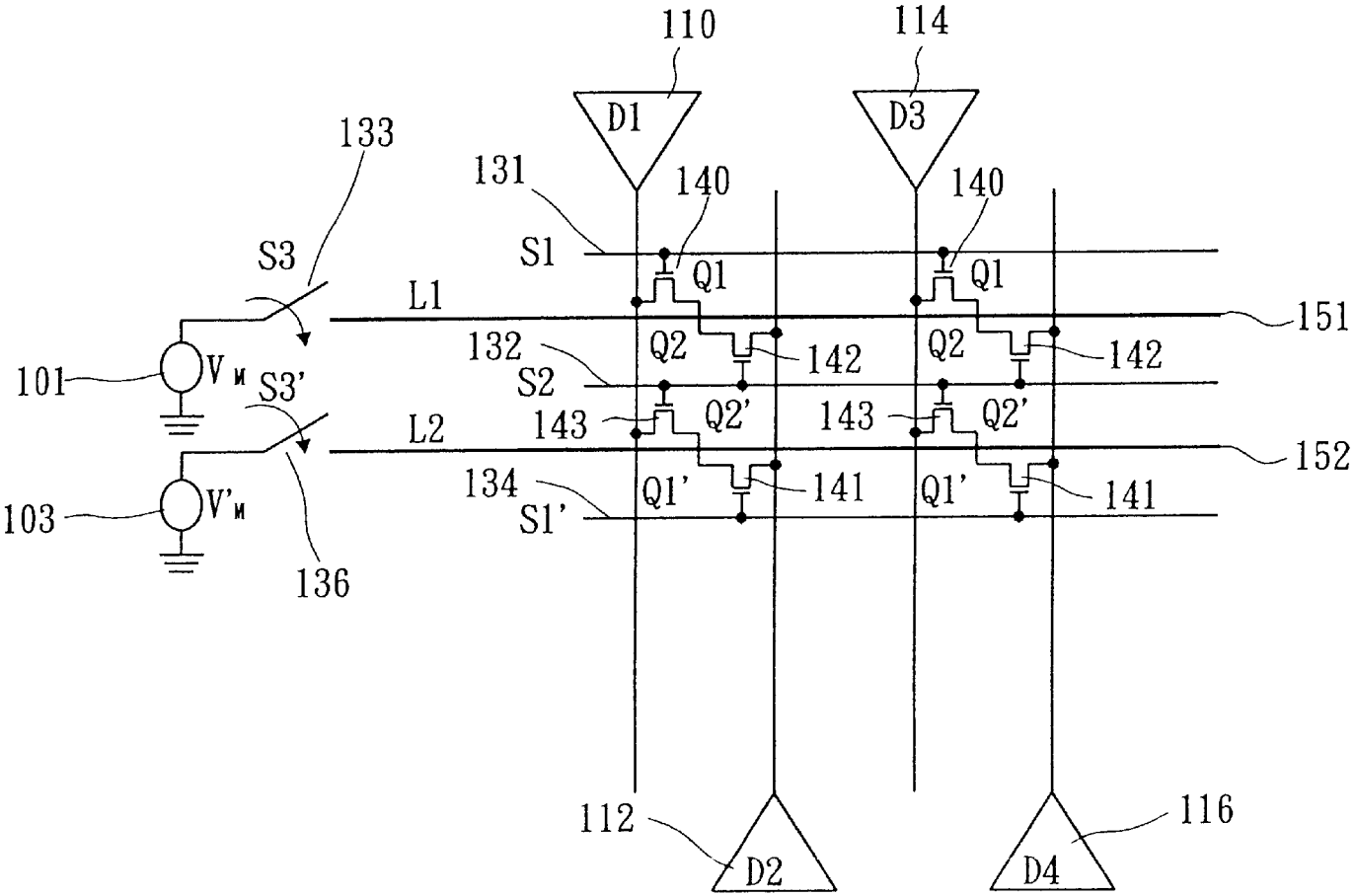
FIG. 7 is a circuit diagram showing a schematic driving circuit of a liquid crystal display in accordance with the third embodiment of the present invention.

Furthermore, according to the present invention, the connection between the charge storage lines and the charge/discharge signal lines at the outputs of the multistage voltage regulation circuits can perform both polarity alternating and polarity non-alternating. Please refer to FIG. 6 and FIG. 7, which are, respectively, a circuit diagram showing a schematic driving circuit in accordance with the second embodiment of the present invention and a circuit diagram showing a schematic driving circuit in accordance with the third embodiment of the present invention.

The major difference of the implementation of FIG. 6 from that of FIG. 5A is that the multistage voltage regulation circuit for positive polarity M 100 and the multistage voltage regulation circuit for negative polarity M' 102 are replaced by a voltage leveler for positive polarity $V_M$ 101 and a voltage leveler for negative polarity $V_M'$ 103, respectively. The major difference of the implementation of FIG. 7 from that of FIG. 5A is quite similar to the case of FIG. 6 and FIG. 5A. It is noted that, in FIG. 6, a pair of pre-charge signal line for positive polarity $S_3$ 133 and pre-charge signal line for negative polarity $S_3'$ 136 can be switched to select from the first charge storage line $L_1$ 151 and the second charge storage line $L_2$ 152, so as to perform polarity alternating. It is also noted that, in FIG. 7, the pre-charge signal line for positive polarity $S_3$ 133 and the pre-charge signal line for negative polarity $S_3'$ 136 is directed to the first charge storage line $L_1$ 151 and the second charge storage line $L_2$ 152, respectively, thus the polarity is not alternated.

Figure 8:
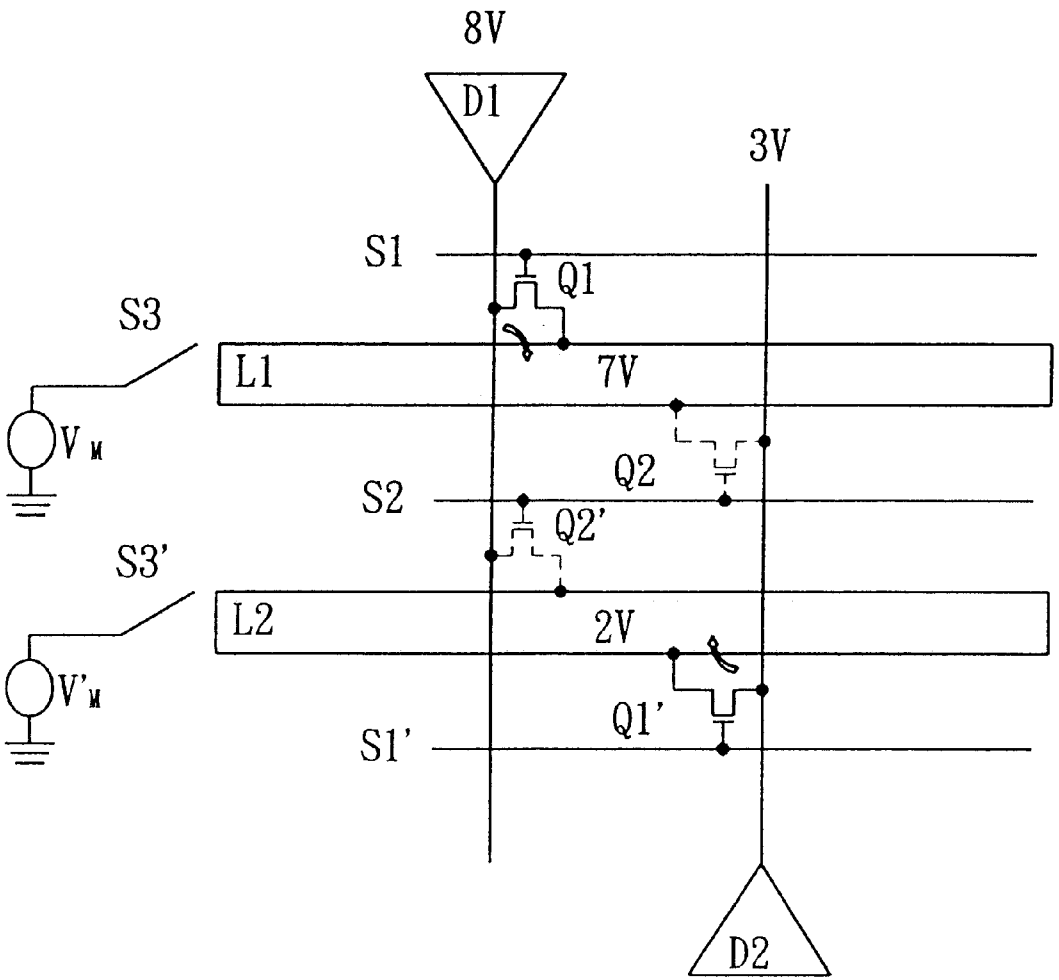
FIG. 8 is a circuit diagram based on the FIG. 6 in accordance with the second embodiment of the present invention, wherein charge-sharing is performed.

For the implementation of charge-sharing, please refer to FIG. 8, which is a circuit diagram based on the FIG. 6 in accordance with the second embodiment of the present invention, wherein charge-sharing is performed. When charge-sharing is performed, the driving circuit $D_1$ coupled to the first switch $Q_1$ on the odd-numbered column charges the first charge storage line $L_1$ and the driving circuit $D_2$ coupled to the first switch $Q_1'$ on the even-numbered column charges the second charge storage line $L_2$, thus completing charge sharing.

Figure 9:
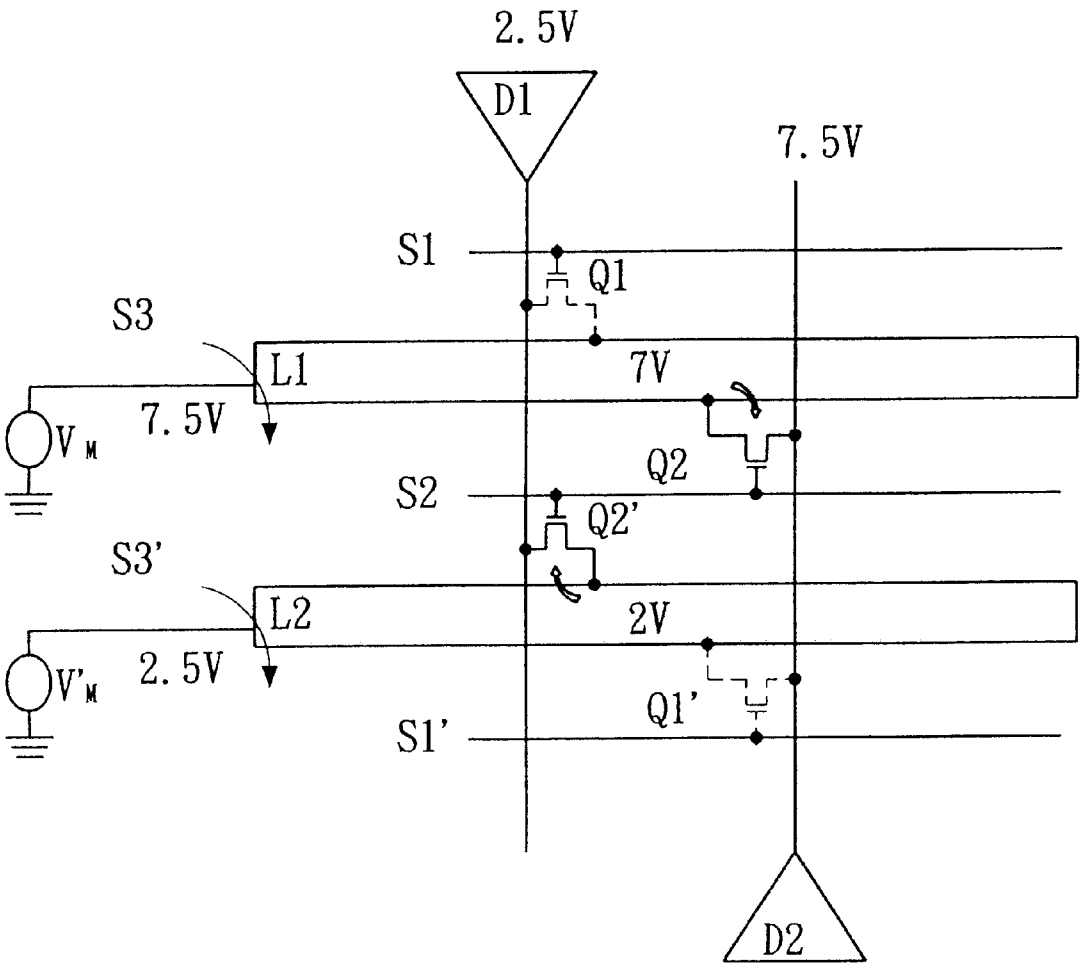
FIG. 9 is a circuit diagram based on the FIG. 6 in accordance with the second embodiment of the present invention, wherein pre-charge is performed.

Furthermore, for the implementation of pre-charge, please refer to FIG. 9, which is a circuit diagram based on the FIG. 6 in accordance with the second embodiment of the present invention, wherein pre-charge is performed. When pre-charge is performed, the first charge/discharge signal lines $S_1$ and $S_1'$ on said odd/even-numbered column are OFF, the second charge/discharge signal line $S_2$ on said odd/even-numbered column is ON, and the pre-charge signal lines $S_3$ and $S_3'$ are ON, wherein the second charge storage line $L_2$, connected to the pre-charge signal line for negative polarity $S_3'$, charges the driving circuit $D_1$ through the second switch $Q_2'$ on said odd-numbered column; on the contrary, the positive voltage on the second charge storage line $L_1$ charges the driving circuit $D_2$ through the second switch $Q_2$ on said even-numbered column, thus completing pre-charge.

Figure 10:
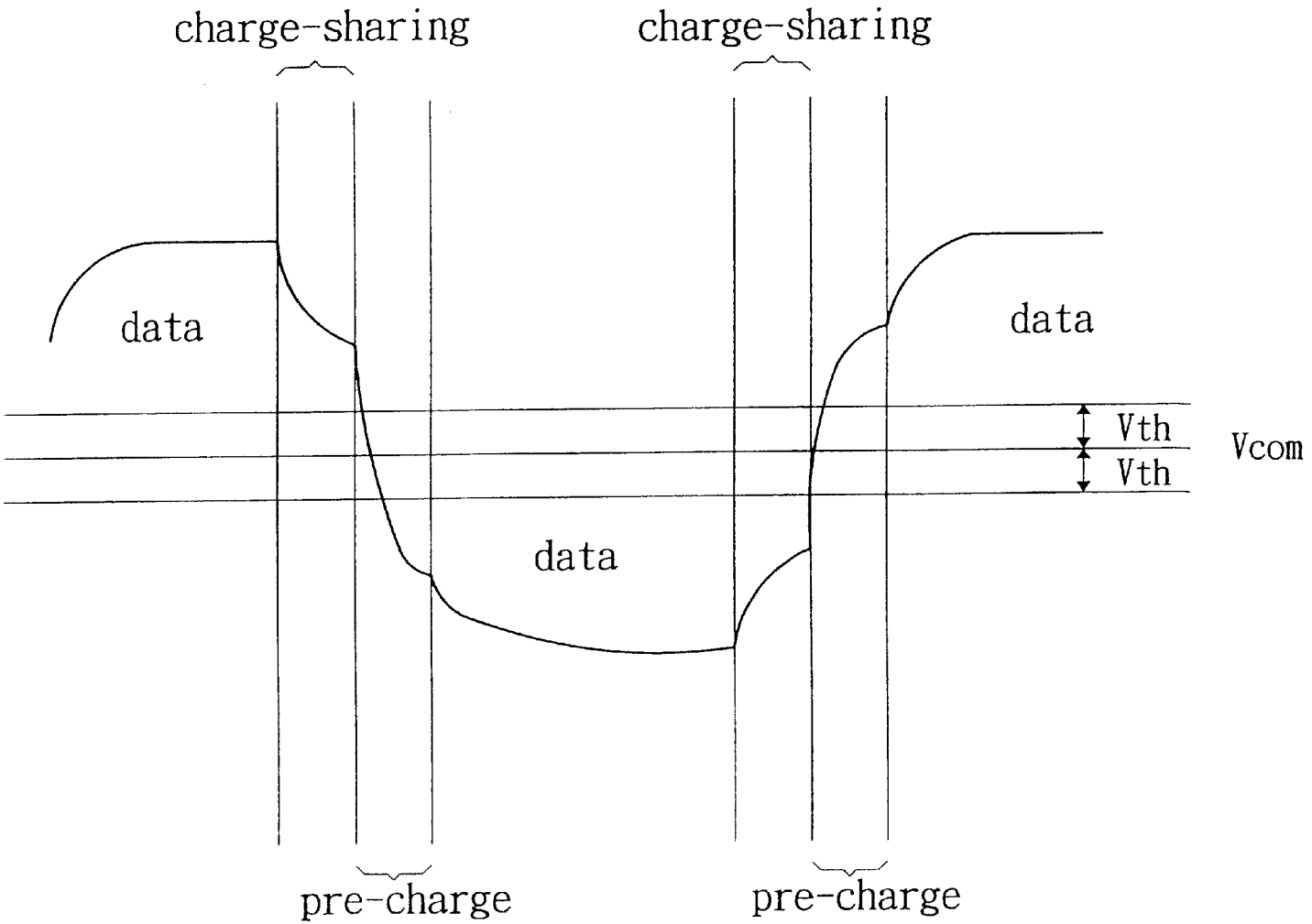
FIG. 10 is a graph showing the voltage waveform on a single data line.
Figure 11:
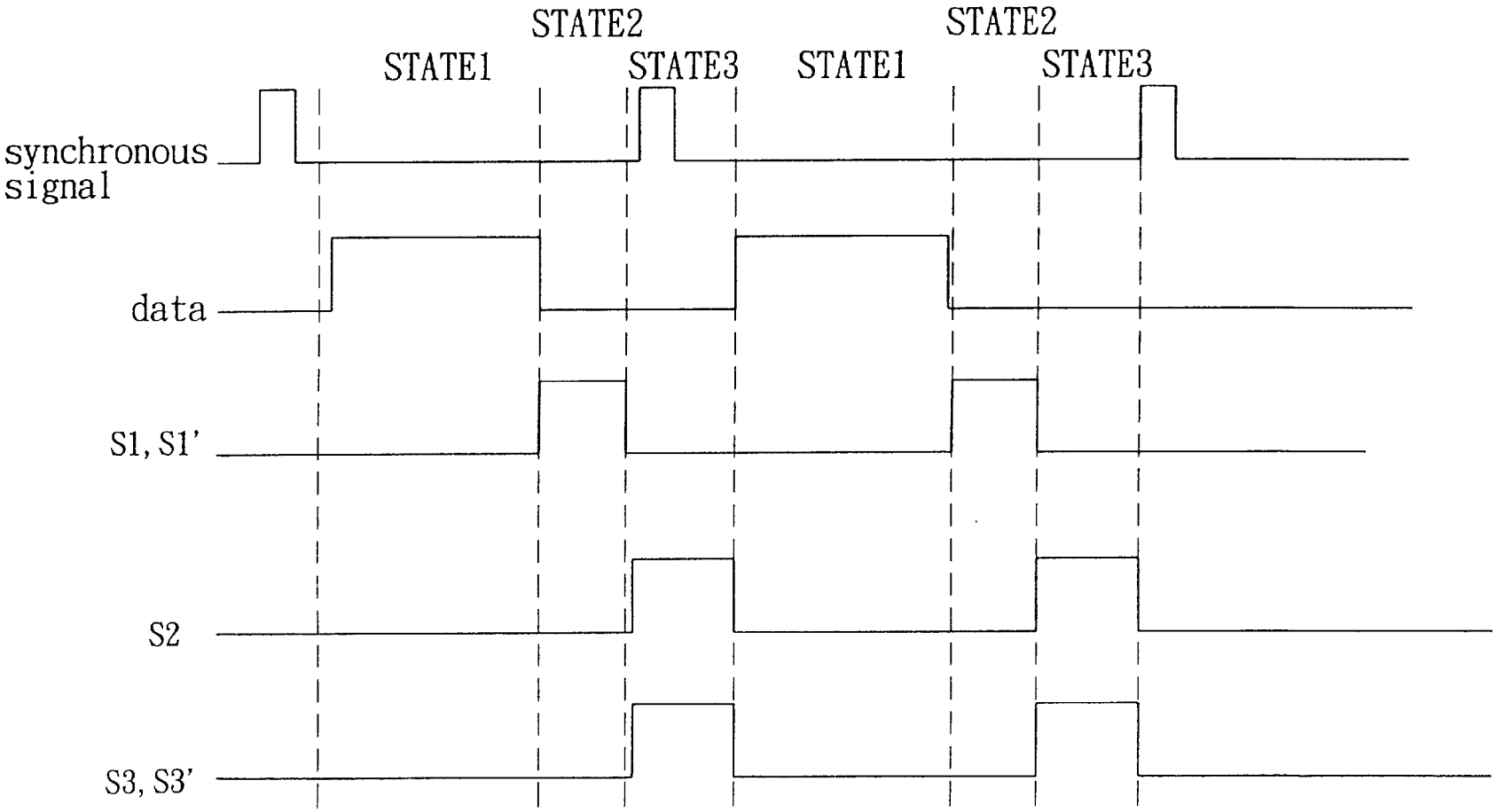
FIG. 11 is a control timing diagram in accordance with the present invention.

For the experimental results according to the present invention, please refer to FIG. 10, which is a graph showing the voltage waveform on a single data line. In the drawing, the charge-sharing and pre-charge are revealed by the voltage variation. It is noted that $V_{com}$ denotes a common voltage level. In addition, FIG. 11 is a control timing diagram in accordance with the present invention, wherein STATE 1 describes the writing process with $S_1$, $S_1'$, $S_2$, $S_3$, and $S_3'$ being all OFF; STATE 2 presents charge-sharing with $S_1$ and $S_1'$ being ON and $S_2$, $S_3$, and $S_3'$ being all OFF; and STATE 3 denotes multistage pre-charge with $S_1$ and $S_1'$ being OFF and $S_2$, $S_3$, and $S_3'$ being all ON.

Figure 12:
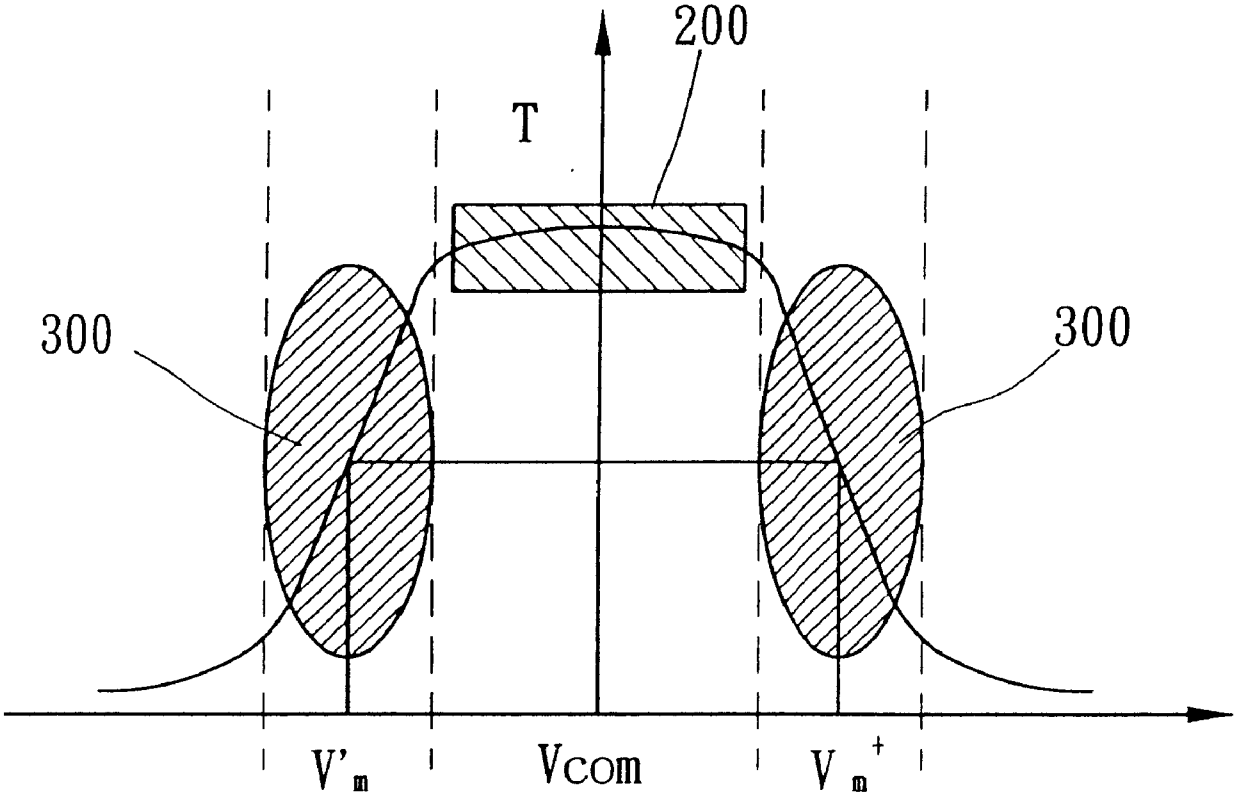
FIG. 12 shows the comparison in gray-scale precision between the charging region in the prior art and the charging region diagram in accordance with the present invention.

Furthermore, please refer to FIG. 12, which shows the comparison in gray-scale precision between the charging region in the prior art and the charging region diagram in accordance with the present invention, wherein the vertical coordinate presents the voltage (V) and horizontal coordinate presents the gray-scale intensity. It is noted that the gray-scale area 200 is the region of precise charging according to the prior art and the gray-scale area 300 is the region of precise charging according to the present invention. It is obvious that the present invention has the advantage in larger charging region of precise charging and higher gray-scale precision.

As discussed so far, in accordance with the present invention, there is provided a multistage charging driving circuit for liquid crystal displays, being able to perform charge-sharing and pre-charge on the pixels of liquid crystal displays, resulting power dissipation reduction. Consequently, the present invention has been examined to be progressive and has great potential in commercial applications.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A multistage charging driving circuit for liquid crystal displays, comprising:

multistage voltage regulation circuits, coupled to voltage sources for providing different voltage levels selected by selecting signal;

a plurality of charge/discharge signal lines and charge storage lines, wherein a pair of pre-charge signal lines are connected to the output of said multistage voltage regulation circuits, respectively, and the other ends of said pair of pre-charge signal lines are connected to said charge storage lines, respectively, so as to store and/or release the charge; wherein a pair of charge/discharge signal lines and a signal line are coupled and interlacingly arranged in parallel with said charge storage lines; wherein a plurality of pairs of are arranged between said plurality of charge/discharge signal lines and charge storage lines, wherein said plurality of pairs of switches perform charge-sharing and pre-charge by using said charge storage lines to store and/or release the charge; and a plurality of driving circuits, interlacingly arranged at the sources and the drains of said plurality of pairs of switches, so as to determine the ON/OFF state of the switches;

wherein said plurality of pairs of switches are different from the data switches of the plurality of pixels of LCDs.

2. The multistage charging driving circuit for liquid crystal displays as recited in claim 1, wherein said charge storage lines can be implemented by using a metal wire so as to perform charge storage and reduce the voltage swing.

3. The multistage charging driving circuit for liquid crystal displays as recited in claim 1, wherein said charge storage lines are further connected to large external storage capacitor so as to perform charge storage.

4. The multistage charging driving circuit for liquid crystal displays as recited in claim 1, wherein the connection between said charge storage lines and said pre-charge signal lines at the outputs of said multistage voltage regulation circuits can perform polarity alternating.

5. The multistage charging driving circuit for liquid crystal displays as recited in claim 1, wherein the connection between said charge storage lines and said pre-charge signal lines at the outputs of said multistage voltage regulation circuits can perform polarity non-alternating.

6. The multistage charging driving circuit for liquid crystal displays as recited in claim 1, wherein said plurality of charge/discharge signal lines include a first odd-numbered charge/discharge signal line $S_1$, a first even-numbered charge/discharge signal line $S_1'$, and a second odd-numbered charge/discharge signal line $S_2$, said pre-charge signal lines are $S_3$ and $S_3'$, said charge storage lines are $L_1$ and $L_2$, wherein the interlacing arrangement is characterized in that the first odd-numbered charge/discharge signal line $S_1$ is followed by the first charge storage line $L_1$, then the second odd-numbered charge/discharge signal line $S_2$, then the second charge storage line $L_2$, and finally the first even-numbered charge/discharge signal line $S_1'$; wherein, the pre-charge signal lines $S_3$ and $S_3'$ can be switched to determine the polarity of said first and second charge storage lines $L_1$ and $L_2$.

7. The multistage charging driving circuit for liquid crystal displays as recited in claim 6, wherein the arrangement of the charge/discharge signal lines $S_1$ and $S_2$, the charge storage lines $L_1$ and $L_2$, along with the switches $Q_1$, $Q_1'$, $Q_2$, and $Q_2'$ is characterized in that the gates of the first switches $Q_1$ on odd-numbered columns are coupled to the first charge/discharge. signal line $S_1$ on said odd-numbered columns, and the other two terminals (i.,e., drains and sources) of the first switches $Q_1$ on said odd-numbered columns are coupled to driving circuits $D_1$, $D_3$, and the first charge storage line $L_1$; that the gates of the second switches $Q_2$ on even-numbered columns are coupled to the second charge/discharge signal line $S_2$ on said odd/even-numbered columns, and the other two terminals (i.e., drains and sources) of the second switches $Q_2$ on even-numbered columns are coupled to driving circuits $D_2$, $D_4$, and the first charge storage line $L_1$; that the gates of the second switches $Q_2'$ on said odd-numbered columns are coupled to second charge/discharge signal line $S_2$ on said odd/even-numbered columns, and the other two terminals (i.e., drains and sources) of the second switches $Q_2'$ on said odd-numbered columns are coupled to driving circuits $D_1$, $D_3$, and the second charge storage line $L_2$; and that the gates of the first switches $Q_1'$ on said even-numbered columns are coupled to the first charge/discharge signal line $S_1'$ on said even-numbered columns, and the other two terminals (i.e., drains and sources) of the first switches $Q_1'$ on said even-numbered columns are coupled to driving circuits $D_2$, $D_4$, and the second charge storage line $L_2$.

8. The multistage charging driving circuit for liquid crystal displays as recited in claim 7, wherein when charge-sharing is performed, the driving circuit $D_1$ coupled to the first switch $Q_1$ on the odd-numbered column charges the first charge storage line $L_1$ and the driving circuit $D_2$ coupled to the first switch $Q_1'$ on the even-numbered column charges the second charge storage line $L_2$, thus completing charge sharing.

9. The multistage charging driving circuit for liquid crystal displays as recited in claim 7, wherein when pre-charge is performed, the first charge/discharge signal lines $S_1$ and $S_1'$ on said odd/even-numbered column are OFF, the second charge/discharge signal line $S_2$ on said odd/even-numbered column is ON, and the pre-charge signal lines $S_3$ and $S_3'$ are ON, wherein the second charge storage line $L_2$, connected to the pre-charge signal line for negative polarity $S_3'$, charges the driving circuit $D_1$ through the second switch $Q_2'$ on said odd-numbered column; on the contrary, the positive voltage on the second charge storage line $L_1$ charges the driving circuit $D_2$ through the second switch $Q_2$ on said even-numbered column, thus completing pre-charge.

10. A multistage charging driving circuit for liquid crystal displays, comprising:

voltage levelers for positive polarity and negative polarity, for providing different voltage levels;

a plurality of charge/discharge signal lines and charge storage lines, wherein a pair of pre-charge signal lines are connected to the output of said voltage levelers, respectively, and the other ends of said pair of pre-charge signal lines are connected to said charge storage lines, respectively, so as to store and/or release the charge; wherein a pair of charge/discharge signal lines and a signal line are coupled and interlacingly arranged in parallel with said charge storage lines; wherein a plurality of pairs of are arranged between said plurality of charge/discharge signal lines and charge storage lines, wherein said plurality of pairs of switches perform charge-sharing and pre-charge by using said charge storage lines to store and/or release the charge;

a plurality of external storage capacitors coupled between ground and each of the charge storage lines, so as to perform charge storage and reduce the voltage swing; and a plurality of driving circuits, interlacingly arranged at the sources and the drains of said plurality of pairs of switches, so as to determine the ON/OFF state of the switches;

wherein said plurality of pairs of switches are independent of the In data switches of the plurality of pixels of LCDs.

11. The multistage charging driving circuit for liquid crystal displays as recited in claim 10, wherein said plurality of charge/discharge signal lines include a first odd-numbered charge/discharge signal line $S_1$, a first even-numbered charge/discharge signal line $S_1'$, and a second odd-numbered charge/discharge signal line $S_2$, said pre-charge signal lines are $S_3$ and $S_3'$, said charge storage lines are $L_1$ and $L_2$, wherein the interlacing arrangement is characterized in that the first odd-numbered charge/discharge signal line $S_1$ is followed by the first charge storage line $L_1$, then the second odd-numbered charge/discharge signal line $S_2$, then the second charge storage line $L_2$, and finally the first even-numbered charge/discharge signal line $S_1'$; wherein, the pre-charge signal lines $S_3$ and $S_3'$ can be switched to determine the polarity of said first and second charge storage lines $L_1$ and $L_2$.

12. The multistage charging driving circuit for liquid crystal displays as recited in claim 11, wherein the arrangement of the charge/discharge signal lines $S_1$ and $S_2$, the charge storage lines $L_1$ and $L_2$, along with the switches $Q_1$, $Q_1'$, $Q_2$, and $Q_2'$ is characterized in that the gates of the first switches $Q_1$ on odd-numbered columns are coupled to the first charge/discharge signal line $S_1$ on said odd-numbered columns, and the other two terminals (i.e., drains and sources) of the first switches $Q_1$ on said odd-numbered columns are coupled to driving circuits $D_1$, $D_3$, and the first charge storage line $L_1$; that the gates of the second switches $Q_2$ on even-numbered columns are coupled to the second charge/discharge signal line $S_2$ on said odd/even-numbered columns, and the other two terminals (i.e., drains and sources) of the second switches $Q_2$ on even-numbered columns are coupled to driving circuits $D_2$, $D_4$, and the first charge storage line $L_1$; that the gates of the second switches $Q_2'$ on said odd-numbered columns are coupled to second charge/discharge signal line $S_2$ on said odd/even-numbered columns, and the other two terminals (i.e., drains and sources) of the second switches $Q_2'$ on said odd-numbered columns are coupled to driving circuits $D_1$, $D_3$, and the second charge storage line $L_2$; and that the gates of the first switches $Q_1'$ on said even-numbered columns are coupled to the first charge/discharge signal line $S_1'$ on said even-numbered columns, and the other two terminals (i.e., drains and sources) of the first switches $Q_1'$ on said even-numbered columns are coupled to driving circuits $D_2$, $D_4$, and the second charge storage line $L_2$.

13. The multistage charging driving circuit for liquid crystal displays as recited in claim 12, wherein when charge-sharing is performed, the driving circuit $D_1$ coupled to the first switch $Q_1$ on the odd-numbered column charges the first charge storage line $L_1$ and the driving circuit $D_2$ coupled to the first switch $Q_1'$ on the even-numbered column charges the second charge storage line $L_2$, thus completing charge sharing.

14. The multistage charging driving circuit for liquid crystal displays as recited in claim 12, wherein when pre-charge is performed, the first charge/discharge signal lines $S_1$ and $S_1'$ on said odd/even-numbered column are OFF, the second charge/discharge signal line $S_2$ on said odd/even-numbered column is ON, and the pre-charge signal lines $S_3$ and $S_3'$ are ON, wherein the second charge storage line $L_2$, connected to the pre-charge signal line for negative polarity $S_3'$, charges the driving circuit $D_1$ through the second switch $Q_2'$ on said odd-numbered column; on the contrary, the positive voltage on the second charge storage line $L_1$ charges the driving circuit $D_2$ through the second switch $Q_2$ on said even-numbered column, thus completing pre-charge.

* * * * *